US006820951B2

(12) United States Patent
Fukushima et al.

(10) Patent No.: US 6,820,951 B2
(45) Date of Patent: Nov. 23, 2004

(54) TAG HOLDING MEMBER, AND DEVICE INCLUDING TAG HOLDING MEMBER

(75) Inventors: Yukihiro Fukushima, Ikoma (JP); Masaaki Hashimoto, Katano (JP); Yoshitsugu Morimoto, Takaichi-gun (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 10/379,538

(22) Filed: Mar. 6, 2003

(65) Prior Publication Data

US 2003/0168950 A1 Sep. 11, 2003

(30) Foreign Application Priority Data

Mar. 7, 2002 (JP) ..... 2002-061439

(51) Int. Cl.[7] ..... A47B 81/00
(52) U.S. Cl. ..... 312/223.2
(58) Field of Search ..... 312/7.2, 223.1, 312/223.2; 24/458, 457; 40/663, 668, 649, 629, 625; 248/686, 200

(56) References Cited

U.S. PATENT DOCUMENTS 3,404,629 A * 10/1968 Thollefsen ..... 101/369
5,138,524 A * 8/1992 Smithers ..... 361/704
5,573,317 A * 11/1996 Cavanaugh et al. ..... 312/7.2
5,956,821 A * 9/1999 Kurek et al. ..... 24/458
5,987,714 A * 11/1999 Smith ..... 24/295

FOREIGN PATENT DOCUMENTS

JP 01106199 A 4/1989

* cited by examiner

*Primary Examiner*—Milton Nelson, Jr.
(74) *Attorney, Agent, or Firm*—Parkhurst & Wendel, L.L.P.

(57) ABSTRACT

With a tag holding member and a device including the tag holding member, a commodity product can be detected by a detector even if the product is taken out of a packaging case. A holding member with a tag member includes a holding part having a groove for engaging with an upper end part of a chassis and a projection for engaging in an opening of the chassis, whereby the engaging part is engaged with and held by the upper side face and the opening of the chassis with high precision. The tag member is provided at a higher position than the upper end part of the chassis, and a distance from the outer cover can be set optionally. The holding member is held at the side face part of the chassis and covered with the outer cover, therefore the member can be held inside the commodity product.

7 Claims, 7 Drawing Sheets

TAG HOLDING MEMBER, AND DEVICE INCLUDING TAG HOLDING MEMBER

FIELD OF THE INVENTION

The present invention relates to a holding member for a security tag member for protecting a commodity product from theft, and a device including the tag holding member.

BACKGROUND OF THE INVENTION

In recent years, security apparatuses using security tag members (hereinafter, simply called a tag member) detectable from outside are widely used for the purpose of protecting commodity products from theft. According to a conventional security apparatus, a tag member detectable from outside is attached, using a pressure sensitive adhesive sheet, to an opening and closing part on the outside of a packaging case containing a commodity product, and carrying out of the packaging case is detected by a detector comprising an electric or magnetic unit installed at an exit or the like of a store, thereby to prevent stealing of commodity products (for example, Japanese Utility Model No. 3041285).

As widely known, there are typical detectors constituted by the electric or magnetic units, that are of ① a magnetic type, ② a radio frequency type, and ③ an acoustomagnetic type. In ① the magnetic type, amorphous metal is used as a material of the tag member, whereby the presence of the tag member is detected. Amorphous metal has a property of being very easily magnetized. When the amorphous metal enters a magnetic field made by an external detector or the like, it is influenced by an AC magnetic field so that the tag member itself is magnetized and generates electrical pulse with high directivity. When a receiving antenna of the detector senses a noise caused by this pulse, an alarm is generated.

In ② the radio frequency type, a tag member comprises an LC resonance circuit having a combination of inductors and capacitors. When the tag member enters an area between a transmitting and a receiving antennas of the detector, the tag member resonates and reradiates a radio wave with the same frequency. The reradiated radio wave is deviated in phase from the radio wave from the transmitting antenna of the detector, and therefore the detector senses this and generates an alarm.

In ③ the acoustomagnetic type used is a tag member with a plurality of thin sheets of amorphous metal being arranged in parallel. The tag member receives a radio wave outputted by being switched on and off at very short intervals from the transmitting antenna of the detector, and resonates, and the tag member itself outputs a very weak radio wave. In this situation, the presence of the tag member is detected according to the attenuating radio wave outputted from the tag member even after the radio wave radiation from the transmitting antenna is stopped.

The tag members are attached to the packaging cases for most of the commodity products (such as DVD players) that are on sale while contained in packaging cases. Such cases are easily damaged during transportation. Accordingly, the tag members must be attached after the commodity products are delivered to retail stores.

Thus, a construction is proposed according to which the tag member is attached inside the packaging case. FIG. 7 is a sectional view showing such mounting of a conventional tag member 32, and reference numeral 30 denotes a commodity product to be protected such as a DVD player. Reference numeral 31 denotes a cushion for protecting the commodity product 30 during transportation, a recessed portion is formed on a surface of an outer side of the cushion 31, and the tag member 32 is attached to this recessed portion. Reference numeral 33 denotes a packaging case for containing them. According to this construction, the tag member 32 is never damaged during transportation, and therefore the tag member 32 can be mounted at a manufacturing factory before transportation.

However, the above-described conventional construction has a problem that, irrespective of whether the tag member 32 is placed either outside or inside of the packaging case 33, if only the commodity product 30 is illegally taken out of the packaging case 33 with the cushion 31 being left, such illegal act cannot be detected.

DISCLOSURE OF THE INVENTION

The present invention has an object to solve the above conventional problem, by providing a tag holding member with a detectable structure even when a commodity product is taken out of a packaging case, and a device including the tag holding member.

In order to attain this object, the present invention provides a tag holding member including a holding part for guiding and holding a tag member detectable from outside, and an engaging part for engaging with a chassis of a device to be protected, in which a groove for holding a side face part of the chassis, and a projecting part for engaging in an opening provided in the side face part of the chassis are formed at the engaging part. According to the present invention, the holding part has a lid integrally formed therewith via a hinge, and engaging hooks for engaging with the lid, wherein the lid is openable and closable with respect to the holding part, and the engaging hooks hold the tag member in a closed state with the holding part and the lid. The present invention provides a device including a chassis having an opening for engaging with the projecting part in a side face part, and an outer cover having a side face part opposed to the side face part of the chassis. According to this construction, the holding member for holding the tag member is held at the side face part of the chassis, and is covered with the outer cover, and therefore the tag member is reliably held inside the commodity product to be detectable. Since the mounting of the holding member can be widely selected at both left and right side faces of the chassis, a security device easily placed to an effective detection position with high flexibility of design can be obtained. The present invention will be explained more specifically next.

The tag holding member of the present invention includes a holding part at an upper portion, for guiding and holding a tag member detectable from outside, and an engaging part in a lower portion, which is held at a device to be protected, and a groove for holding a side face part of a chassis of the device to be protected, and a projecting part for engaging in an opening provided in the side face part of the chassis are formed at the engaging part. According to this constitution, the tag holding member can be easily attached to the side face part of the chassis of the device to be protected.

The tag holding member of the present invention is characterized in that the holding part has a lid integrally formed therewith via a hinge, and engaging hooks for engaging with the lid, the lid being openable and closable with respect to the holding part, and the engaging hooks holding the tag member in a closed state with the holding part and the lid. According to the construction, a pressure sensitive adhesive sheet for mounting the tag member is not necessary, and the tag member can be held mechanically by the lid with reliability.

The engaging part is characterized by having a taper. According to this construction, mounting to the chassis is facilitated.

A device including the tag holding member according to the present invention is characterized by including a chassis having an opening for engaging with the projecting part of an engaging part in a side face part, and an outer cover having a side face part opposed to the side face part of the chassis, and characterized in that the engaging part is located between the side face part of the chassis and the side face part of the outer cover.

In the device, the holding part is provided at a higher position than an upper end of the side face part of the chassis. According to this construction, the distance from the metal outer cover can be set optionally, interference in the placement of the components on the chassis can be avoided, and a detection failure caused by the metal chassis itself can be avoided, thus facilitating the placement of the tag member at an effective detection position.

In the device, an engaging length in a direction of plate thickness of the chassis is formed to be longer than a clearance formed between an inner face of the outer cover and a back face of the engaging part. According to this construction, after the outer cover is mounted, the entire projecting part is not detached from the opening from the dimensional relationship with the aforementioned clearance, even if pressing force of the engaging part, which is elastically deformed, is small, and the engaging part can be reliably held at the chassis side face part.

In the device, the clearance between a back part of a rib of the lid and the inner face of the outer cover is formed to be in a sufficiently small size necessary to hold the lid. Closed engagement of the lid by the engaging hooks is backed up with this placement. As s result, the closed state of the lid is maintained by double steps of the engaging hooks and the small clearance, without using a pressure sensitive adhesive sheet, and the tag member is securely held at the holding part.

As explained thus far, according to the present invention, the holding member for holding the tag member is held inside the commodity product to be protected, and therefore even if only the commodity product to be protected is taken out of the packaging case, the commodity product to be protected can be detected, and protection effect of the commodity product can be enhanced. The mounting position of the holding member can be widely selected in the lengthwise direction of the chassis at both left and right side faces of the chassis, and therefore an excellent effect of realizing a security device with high flexibility of design, which facilitates placement to the effective detection position. The present invention can be made the pressure sensitive adhesive sheet for attaching the tag member unnecessary, and in this case, there is no fear of the tag member falling from the holding part, and the tag member can be held with more reliability. It is made possible to facilitate placement of the tag member to an effective detection position. It is also made possible to hold the holding member at the side face part of the chassis with reliability.

DESCRIPTION OF THE EMBODIMENTS (First Embodiment)

Figure 1:
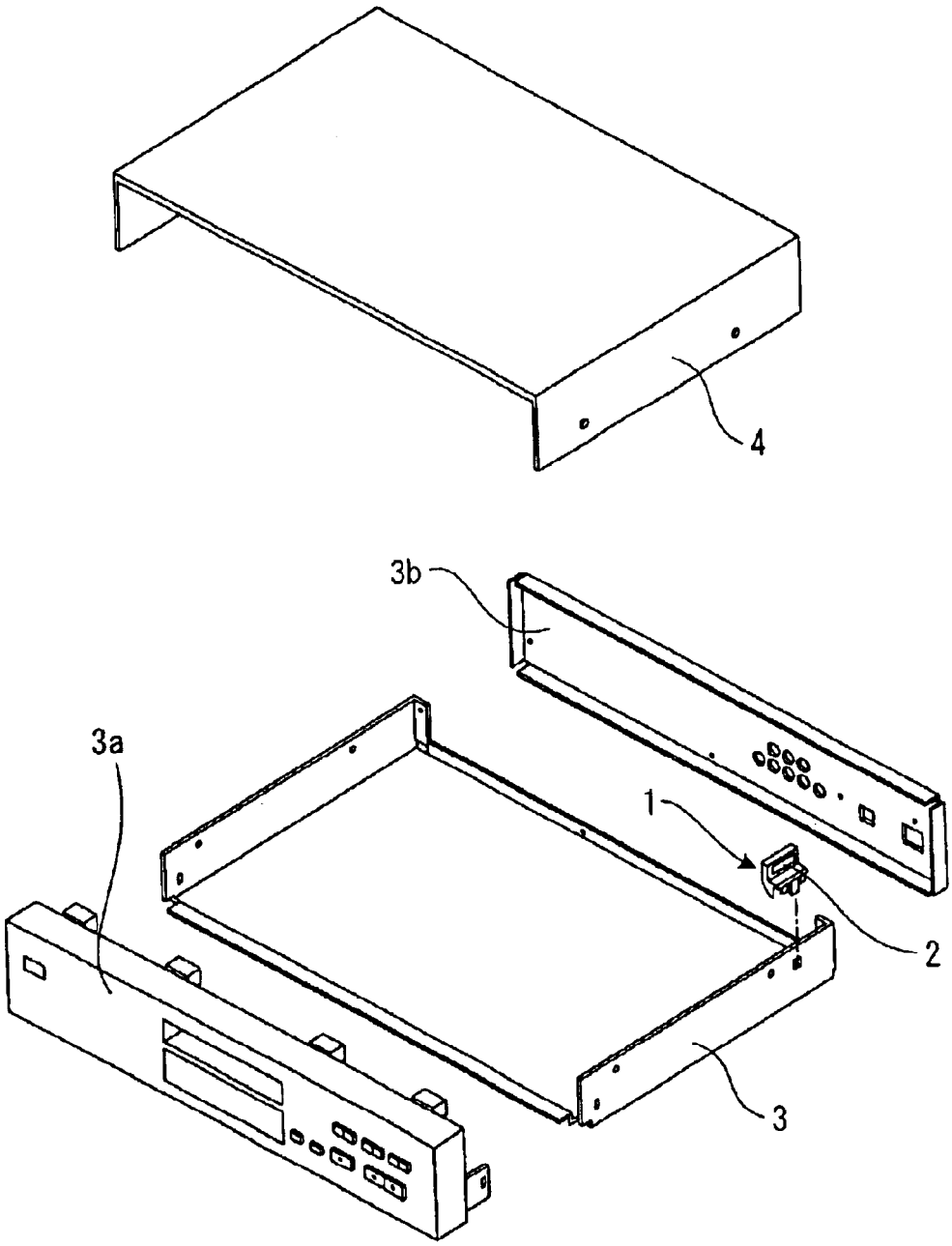
FIG. 1 is an exploded perspective view according to a first embodiment of the present invention.
Figure 2:
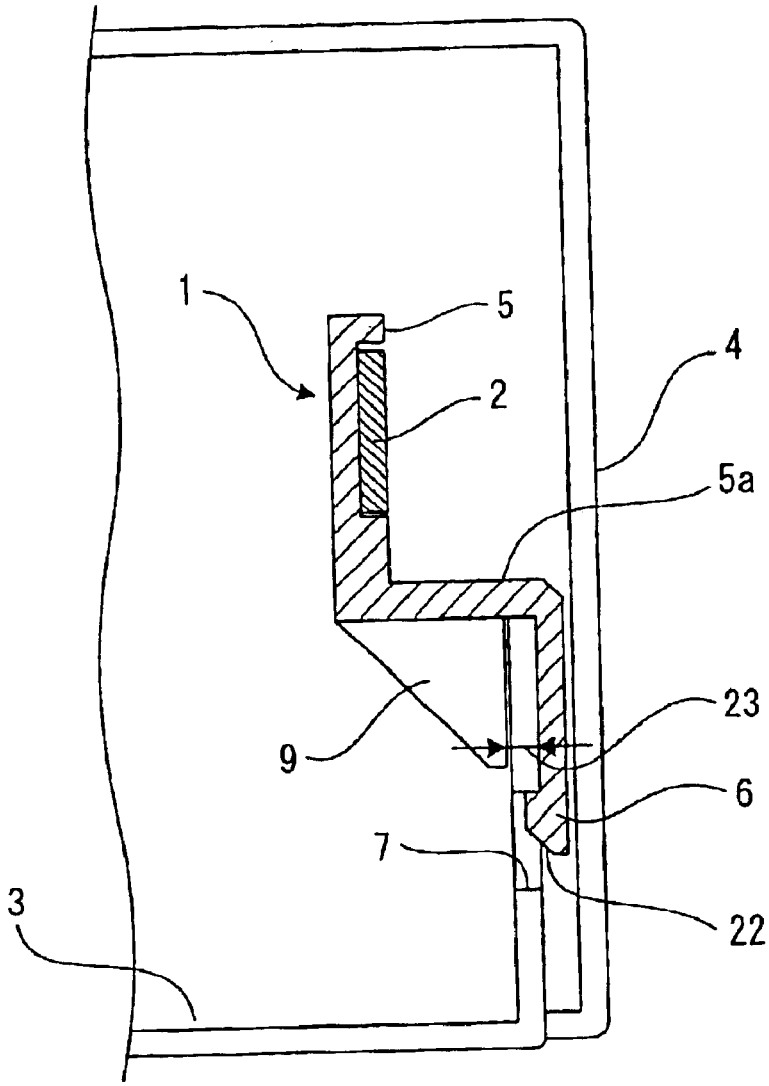
FIG. 2 is a sectional view of an essential part according to the first embodiment of the present invention.
Figure 3:
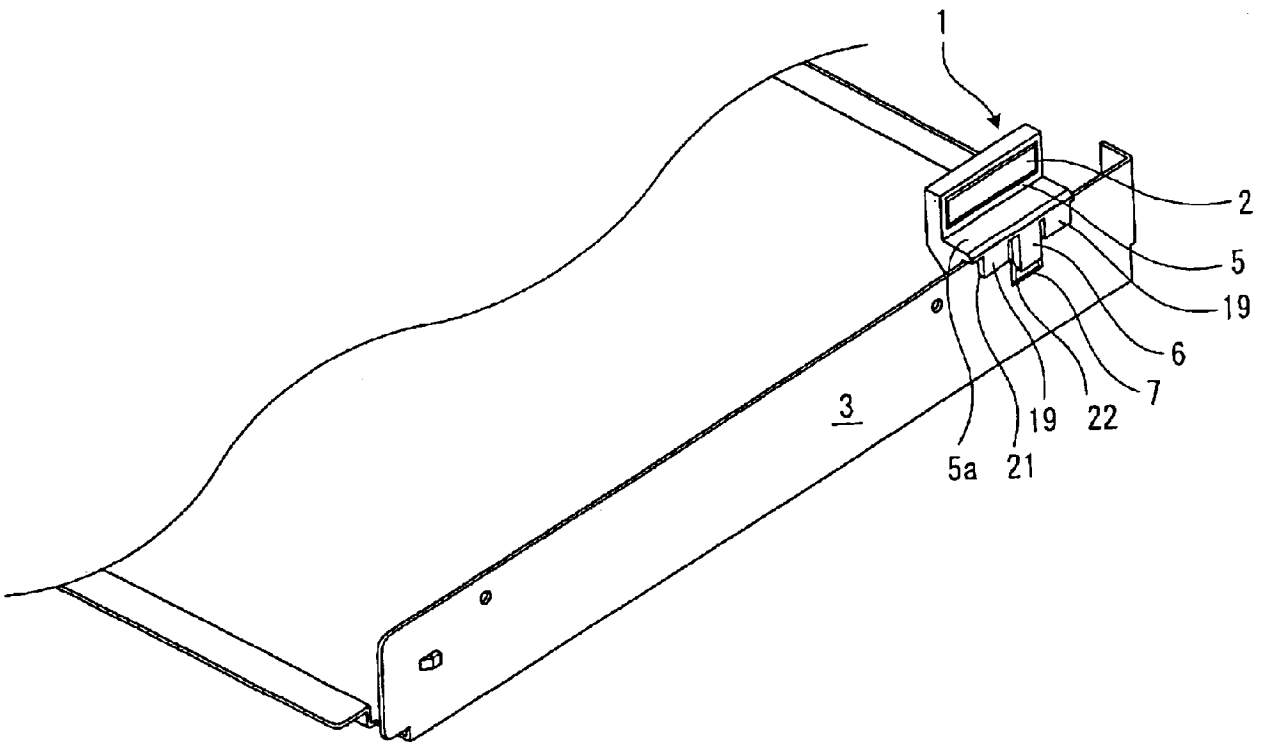
FIG. 3 is a partial perspective view according to the first embodiment of the present invention.

A first embodiment of the present invention will be explained below with use of the drawings. FIG. 1, FIG. 2 and FIG. 3 are an exploded perspective view, a sectional view of an essential part, and a partial perspective view, respectively, and in the drawings, a commodity product (a product to be protected) is constructed by a chassis 3, a front panel 3*a*, a rear panel 3*b* and an outer cover 4. Reference numeral 1 denotes a holding member being a holder made by molding of a synthetic resin, and includes a holding part 5 in a concave shape mainly located at an upper part for a tag member 2, a connection part 5*a* provided at a lower end of the holding part 5 to separate the holding part 5 from the outer cover 4 in the commodity product by an optional fixed distance, and an engaging part 6 located at a lower part. The tagmember 2 is guided into the concave portion of the holding part 5 to be mounted at a predetermined position with a pressure sensitive adhesive sheet such as a double-faced tape, and is detectable even from outside by a detector constituted by an electric or magnetic unit. The chassis 3 has a pair of opposing side face parts at the left and the right, and an opening 7 is formed in the side face of the chassis at a spot where the holding member 1 is mounted.

A groove 23 for holding an upper end part of the chassis 3 is formed between an inner holding member 9 extending downward from a center of the holding member 1 and an outer holding member 19 or the engaging part 6, and a projecting portion for engaging in the opening 7 is formed at a tip end of the engaging part 6, whereby the engaging part 6 is engaged in and held by the upper part of the side face and the opening 7 of the chassis 3 in the commodity product with high precision. A taper 22 is formed at an inner side of a lower end of the projecting portion of the engaging part 6 as shown in FIGS. 2 and 3, and a taper 21 is formed at an inner side of a lower end of the outer holding member 19 to make it easy to attach the holding member 1 to the chassis 3 when the holding member 1 is inserted into the chassis 3 from above. A clearance between the outer cover 4 provided outside the chassis 3 and a back face of the engaging part 6, which becomes an outer end of the holding member 1, is formed to be shorter than the length in an engaging direction of engagement of the projecting portion of the engaging part 6 with the opening 7 of the chassis 3, namely, the length in a plate thickness direction of the chassis 3, whereby the projecting portion of the engaging part 6 is not detached from the opening 7 after the outer cover 4 is mounted on the chassis 3. The holding part 5 is placed at a higher position than the upper end part of the chassis 3, the connection part 5*a* connects the holding part 5 and the engaging part 6 to set a horizontal distance between the tag member 2 and the outer cover 4 optionally. In an acoustomagnetic type which is used in this embodiment, the tag member 2 and metal are placed by being separated from each other by a fixed proper distance by the connection part 5*a* when the metal exists between the detector and the tag member 2, whereby the tab member 2 becomes detectable. This is because when the tag member 2 resonates with an intermittent radio wave outputted from a transmitting antenna of the detector, and reradiates the ratio wave at the same frequency, energy of the radio wave from the tag member 2 is exhausted if metal is near the tag member 2, and the receiving antenna of the detector cannot sense it. The outer cover 4 in the commodity product is usually constructed by a metal material, but the tag member 2 is separated from the outer cover 4 by a fixed distance, whereby the tag member 2 is engaged in and held by the holding member 1 at the side face part of the chassis 3, which is the position suitable for detection, with high precision and reliability.

According to the construction, the holding member 1 for holding the tag member 2 is held at the side face part of the chassis 3 and is covered with the outer cover 4, and therefore the tag member 2 is held inside the commodity product. In addition, mounting of the holding member 1 can be selected widely in the direction of the length of the side face of the chassis 3 at both left and right side faces of the chassis 3, and therefore flexibility of design is enhanced. The holding part 5 is provided at a higher position than the upper end part of the chassis 3, and therefore locational interference with components mounted in the chassis 3 can be easily avoided. The tag member 2 may be constructed by an optional type which can detect the presence or absence of it by a proper detector, and it may be constructed by, for example, the aforementioned magnetic type, or radio frequency type. In the above-described embodiment, the engaging part 6 of the holding member 1 is formed in the projected shape and the engaging part of the chassis 3 is formed by the opening 7, but conversely, it may be suitable to make the engaging part of the holding member 1 an opening and form the engaging part of the chassis 3 in the convex shape.

(Second Embodiment)

Figure 4:
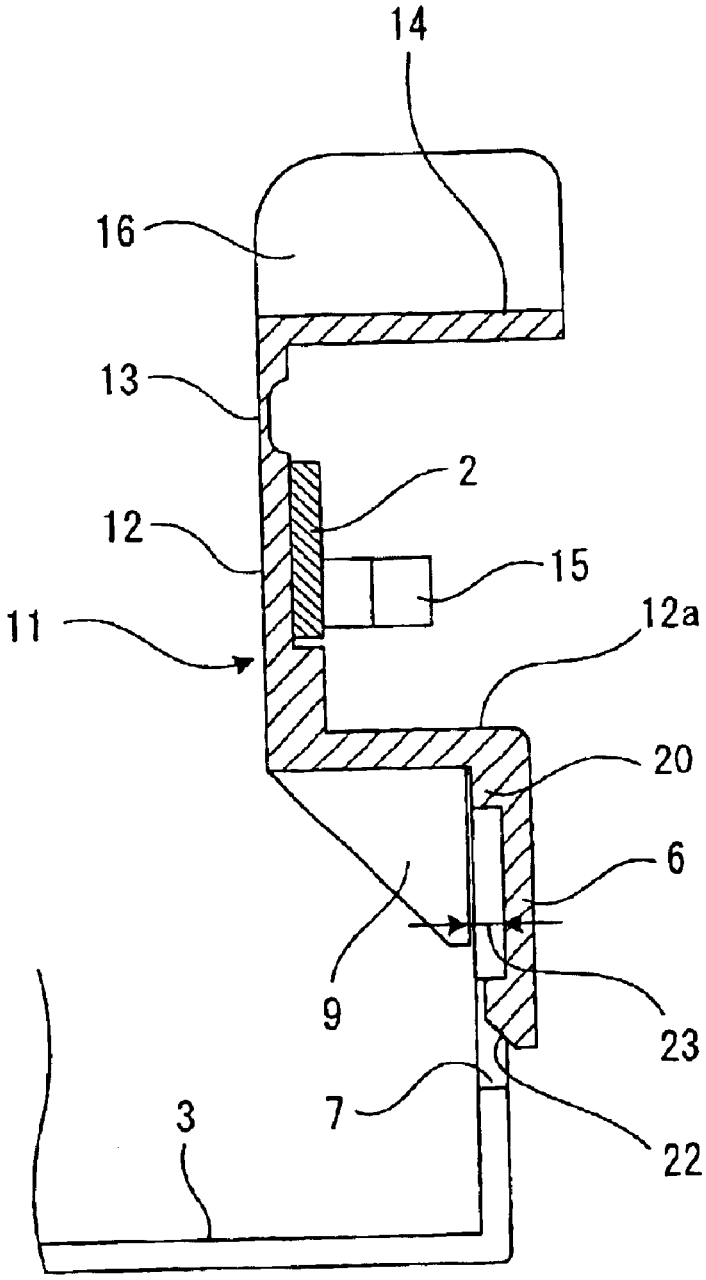
FIG. 4 is a partial sectional view showing a lid in an opened position according to a second embodiment of the present invention.
Figure 5:
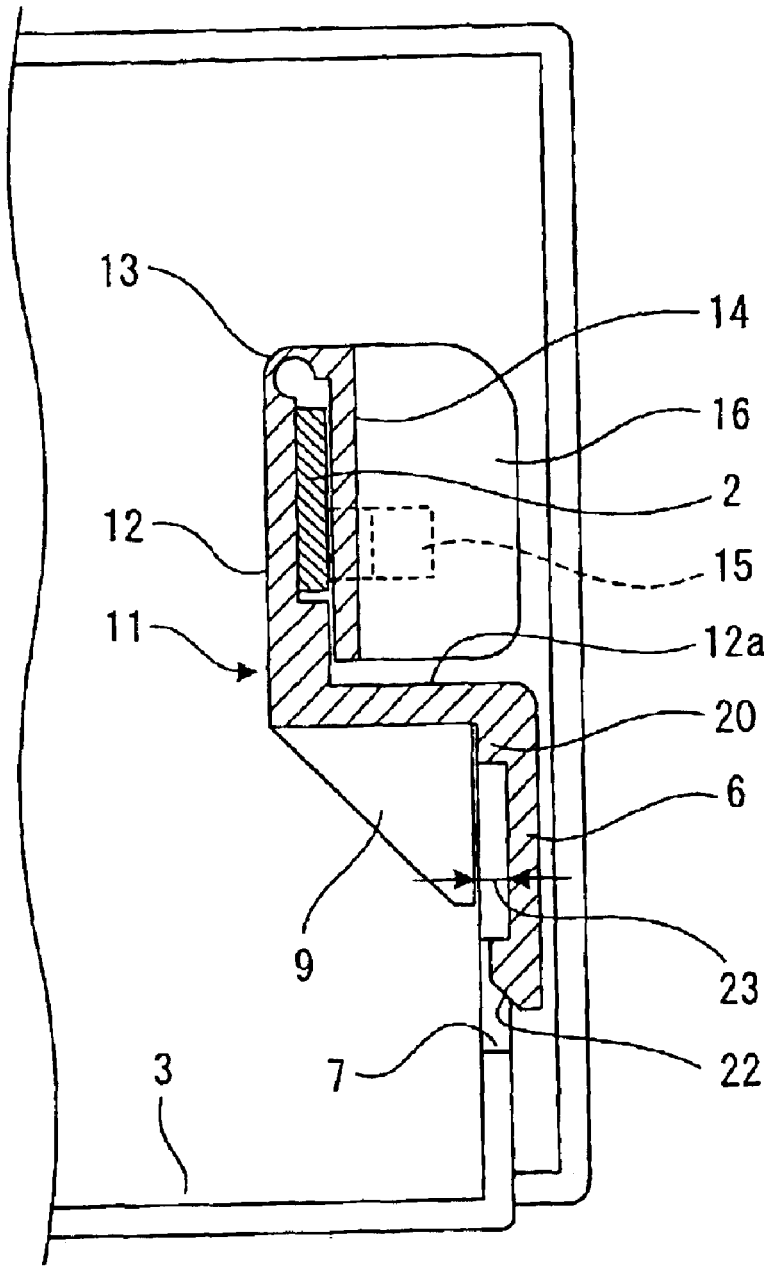
FIG. 5 is a partial sectional view showing the lid in a closed position according to the second embodiment of the present invention.
Figure 6:
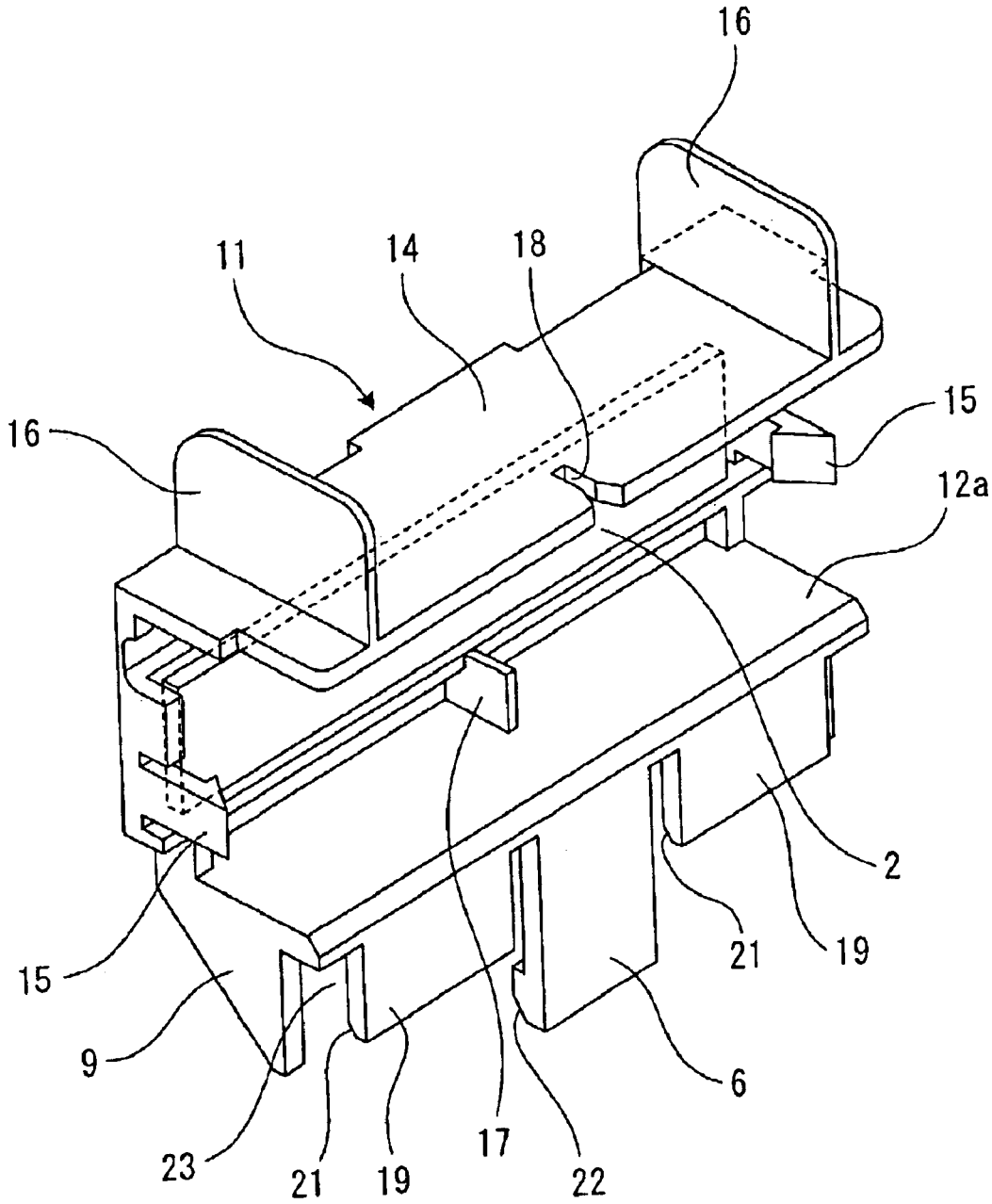
FIG. 6 is a partial perspective view showing the lid in the opened position according to the second embodiment of the present invention.
Figure 7:
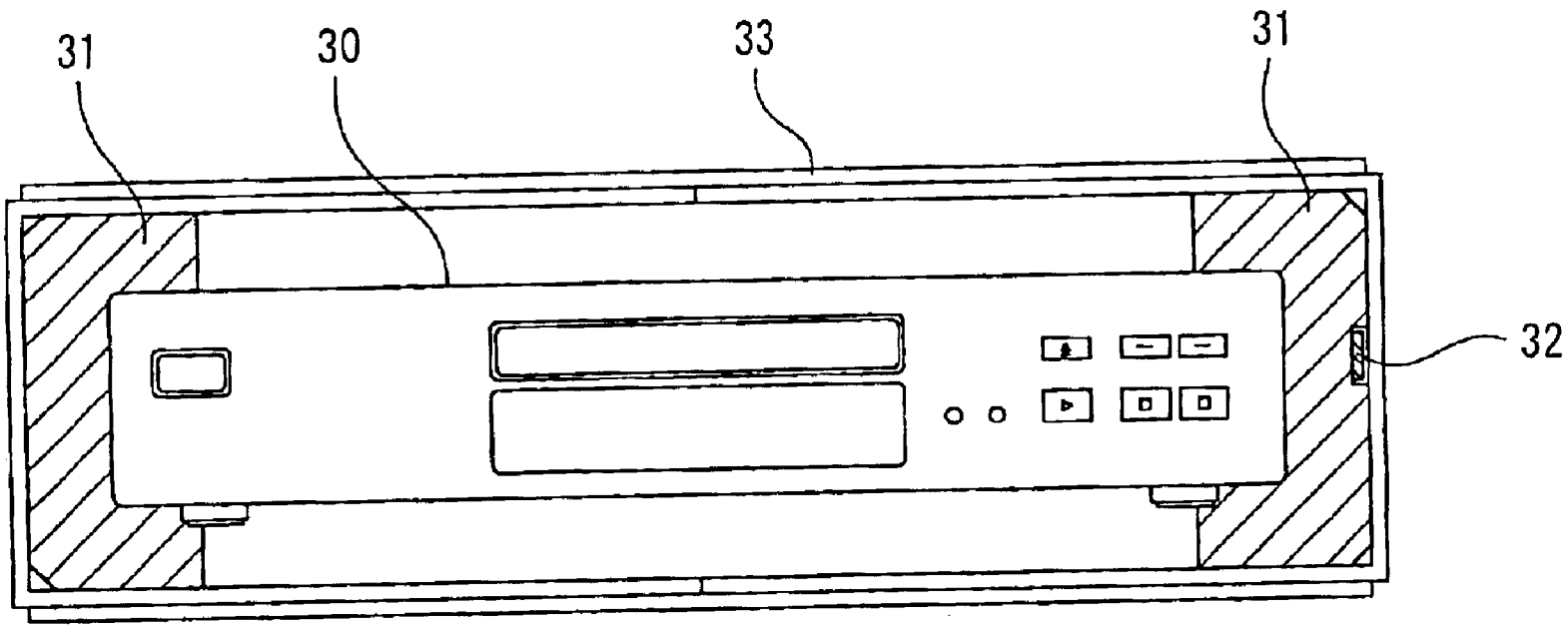
FIG. 7 PRIOR ART
FIG. 7 is a sectional view showing mounting of a tag member in a prior art.

Next, a second embodiment of the present invention will be explained with use of the drawings. The second embodiment relates to another example of the holding member being a holder for guiding and holding the tag member 2. Therefore, the relationship between the components other than the holding member is not different from what is explained in the first embodiment. FIG. 4 and FIG. 5 are partial sectional views according to the second embodiment of the present invention, and FIG. 6 is a partial perspective view thereof. The components in the drawings having the same functions as in the first embodiment are given the same reference numerals, and the explanation thereof will be omitted. In the drawings, reference numeral 11 denotes a holding member being a holder, which is made by molding a synthetic resin similarly to the one explained in the first embodiment, and includes a holding part 12 for guiding and holding the tag member 2, and a lid 14 having a rib 16 provided from the holding part 12 via a hinge 13 with a thin, plate structure by integral molding, and an engaging hooks 15 for engaging with the lid 14 when the lid 14 is closed is formed at the holding part 12. A connection part 12*a* is provided at a lower end of the holding part 12 to separate the holding part 12 from the outer cover 4 at an optional fixed distance as in the first embodiment. The lid 14 is openable and closable with respect to the holding part 12, FIG. 4 shows an opened state and FIG. 5 shows a closed state. Initially, it is provided in the opened state, so that the tag member 2 can be attached in the concave portion of the holding part 12. When the tag member 2 is attached to the holding part 12 and the lid 14 is turned to the closed position, the hinge 13 is bent because it is a thin plate, and the lid 14 is engaged with and held by the engaging hooks 15 provided at both ends of the holding part 12 in the lengthwise direction of the rotational axis. As shown in FIG. 6, an engaging position guiding member 17 and a notch part 18 are attached in the vicinity of centers in the respective lengthwise directions of the holding part 12 and the lid 14 to position and guide the lid 14 in the accurate lengthwise direction when the lid 14 is closed. This is to prevent the engaging hooks 15 from being broken as a result that the lid 14 is displaced to the left and right in the lengthwise direction when an excessive load is applied to the left and right in the lengthwise direction of the lid 14. A clearance between a back part of the rib 16 of the lid 14 which is at a side of the outer cover in the closed state and the inner face of the outer cover 4 is sufficiently reduced to have only a necessary dimension for holding the lid 14 in the closed state. The back part of the rib 16 of the lid 14 which is closed and a back face of the engaging part 6 are in substantially the same vertical relation.

According to this construction, the tag member 2 guided into the concave portion of the holding part 12 is reliably held in the closed state with the holding part 12 and the lid 14 by the aforementioned engaging hooks 15, and therefore a pressure sensitive adhesive sheet for attaching the tag member 2 is not necessary. The clearance between the back portion of the rib 16 of the lid 14 and the inner face of the outer cover 4 can be sufficiently reduced, and the lid 14 is kept in the closed state after the outer cover 4 is mounted. The closing engagement by the engaging hooks 15 and the clearance on the back of the rib 16 as a backup securely keep the closed state of the lid 14. As a result, there is no fear that the tag member 2 falls from the holding part 12 even if the pressure sensitive adhesion sheet is not used, and the tag member 2 is held with reliability.

As shown in FIG. 4 or FIG. 5, an engaging concave part 20 in a downward direction is provided at the holding member 11, and is engaged in an engaging notch at the upper end of the chassis, which has substantially the same length as the engaging concave part 20. As a result, the holding member 11 is restrained in the longitudinal direction of the chassis, and with the restraint in the vertical and the lateral directions by the aforementioned engaging part 6 and the groove 23 formed between the holding members 9 and 19, the holding member 11 is attached in a state in which it is completely restrained and fixed at an optional fixed position of the chassis. Since the aforementioned engaging notch can be provided at a desired fixed spot in the lengthwise direction of the chassis, it is possible to deactivate the tag member 2 which is located at a fixed position of the commodity product for which the payment is reasonably made at a checkout. Accordingly, only the commodity product, which is stolen and not deactivated, is sensed with a detecting device at the exit of a store to raise an alarm, and the commodity product for which the payment is finished does not raise an alarm.

What is claimed is:

1. A tag holding member for attachment to a device, comprising:

a holding part located at an upper part of the holding member for guiding and holding a tag member; and an engaging part located at a lower part of the holding member for engaging a device, said engaging part comprising a groove for engaging a side face of a chassis of such a device, and a projecting part for engaging in an opening in a side face of such a chassis.

2. The tag holding member according to claim 1, wherein said holding part comprises a lid and a hinge connecting the lid to the holding part, and engaging hooks for engaging the lid, said lid for being opened and closed with respect to the holding part, said engaging hooks for holding the lid in a closed state against the holding part with a tag member between the lid and the holding part.

3. The tag holding member according to claim 1, wherein the engaging part comprises a tapered portion.

4. The tag holding member according to claim 1, in combination with a device, further comprising:

a chassis of said device having a wall with a side face comprising an opening for engagement with the projecting part; and an outer cover having an inner face opposed to the side face of the chassis, said engaging part being located between the side face of the chassis and the inner face of the outer cover.

5. The combination according to claim 4, wherein the holding part is located at a position higher than an upper end of the side face of the chassis.

6. The combination according to claim 4, wherein the projecting part has an engaging length in a direction of thickness of the wall of the chassis that is longer than a clearance between the inner face of the outer cover and a rear face of the engaging part.

7. The combination according to claim 4, further comprising a lid comprising ribs, wherein a clearance between said ribs and the inner face of the outer cover is small enough to hold the lid against the holding part when the lid is closed.

* * * * *